US005169673A

United States Patent [19]

Demeny et al.

[11] Patent Number: 5,169,673

[45] Date of Patent: Dec. 8, 1992

[54] METHOD AND APPARATUS FOR ELECTROSTATICALLY SPRAY PAINTING OBJECTS IN A SPRAY PAINT BOOTH

[76] Inventors: Gary L. Demeny, 212 W. 5th St., Delavan, Ill. 61734; Robert G. Smead, 811 S. 7th St., St. Charles, Ill. 60174

[21] Appl. No.: 652,558

[22] Filed: Feb. 7, 1991

Related U.S. Application Data

[63] Continuation-in-part of Ser. No. 495,334, Mar. 19, 1990.

[51] Int. Cl.[5] ..... B05D 1/04; B05B 5/04; B05B 5/10

[52] U.S. Cl. ..... 427/477; 427/483; 118/626; 118/634

[58] Field of Search ..... 427/27, 31, 33; 118/629, 634, DIG. 7, 626; 55/DIG. 46; 98/115.2; 454/50

[56] References Cited

U.S. PATENT DOCUMENTS 3,801,869 4/1974 Masuda ..... 98/115.2 X

FOREIGN PATENT DOCUMENTS 205557 8/1956 Australia ..... 427/27

213625 10/1956 Australia ..... 427/27

3804072 8/1989 Fed. Rep. of Germany ..... 427/13

*Primary Examiner*—Evan Lawrence

[57] ABSTRACT

A spray painting booth for electrostatically painting objects includes encapsulated electrically charged panels which are adapted to repel electrically charged paint particles that are produced by an electrostatic spray painting device. The electrostatic spray painting device is charged to a potential of 60,000 to 135,000 volts DC negative with respect to ground so that the resulting spray of paint particles is negatively charged. An object or article to be painted is disposed in the booth by a conveyor mechanism and is maintained at ground potential. The encapsulated, electrically charged panels or walls of the booth are charged to a potential of 30,000 volts DC negative with respect to ground by a power supply such that the panels are charged to a potential between the negative DC potential with respect to ground to which the spray paint device is charged and the ground potential of the article to be painted. The resulting electrostatic field emanating from the panels repels paint particles that do not adhere to the article and thereby reduces the amount of paint that would otherwise accumulate on surfaces of the spray paint booth near the article being painted.

13 Claims, 3 Drawing Sheets

METHOD AND APPARATUS FOR ELECTROSTATICALLY SPRAY PAINTING OBJECTS IN A SPRAY PAINT BOOTH

CROSS REFERENCE TO RELATED APPLICATION

This application is a continuation-in-part application of U.S. patent application Ser. No. 07/495,334 filed on Mar. 19, 1990.

BACKGROUND OF THE INVENTION

1. Field of the Invention

This invention relates to electrostatically spray painting objects and the booths in which the objects are painted and, more particularly, to a new and improved method of spray painting such objects and new and improved panels used in the spray painting booths to minimize the amount of overspray paint that tends to accumulate on surfaces within the booth.

2. Description of the Prior Art

In electrostatic spray painting of objects, a coating of paint is applied to parts usually in a spray paint booth or enclosure. The parts to be painted may be carried into, through and out of the booth by a conveyor mechanism and the paint is applied by an electrostatic paint applying system. The paint applying system atomizes the paint by converting liquid paint into finely divided paint particles; places an electrical charge on those particles; creates an electrical field between the atomizing device and ground; imparts a velocity to the paint particles so that the particles travel toward the part to be coated; and meters the amount of paint to be applied to the part. The electrically charged paint particles are attracted to and have an affinity for the part to be painted because the part is maintained at ground potential and thereby is at a potential different than that of the paint particles produced by the atomizing device. As a result, an electrical field established between the atomizing device and the part deflects the original trajectory of the charged particles so that they travel in a direction towards the grounded part to be painted.

In an automatic electrostatic system, the atomizing device may be mounted in a fixed position, attached to a gun mover device that provides reciprocating motion or attached to a robot that imparts a predetermined complex motion to the gun. An electrostatic atomizer greatly increases paint transfer efficiency from the gun to the surface to be coated as compared to a non-electrostatic device. Electrostatic systems apply paint at transfer efficiencies (the amount of paint applied to the part as compared to the amount of paint emitted from the spray gun) in the 50%–80% range. Transfer efficiencies rarely, if ever, approach 100%.

The atomized paint that is ejected from the atomizing gun but that does not adhere to the part is sometimes referred to as the overspray. The overspray consists of paint that misses the part or rebounds from the surface of the part being painted and paint particles electrically deflected to surfaces in the spray booth other than the part being painted. For example, such overspray might adhere to metal components of the spray booth and the conveyor mechanism. Most of the overspray is entrained in the spray booth exhaust air. However, a significant amount may become deposited on the spray booth ceiling, conveyor protection components and the conveyor itself. Paint accumulating on these surfaces tend to drop off onto a freshly painted part and thereby causes the part to be rejected. In order to reduce the number of rejected parts, the spray booths must be cleaned periodically such that the amount of time that the spray booth can be used is diminished. The present invention relates to a spray booth in which the amount of overspray that accumulates on surfaces other than the object to be painted is greatly reduced.

SUMMARY OF THE INVENTION

It is an object of the present invention to provide a spray booth for electrostatically spraying of parts that significantly decreases the amount of overspray or paint that accumulates on the internal surfaces and components of the spray booth.

It is another object of the present invention to provide an improved spray booth for electrostatic spraying of objects having new and improved panels for the internal surfaces of the spray booth, in which panels are embedded conductors to establish an appropriate repelling potential on the panels.

It is also an object of the present invention to provide a new and improved method of electrostatically spray painting objects in a spray booth in which both the electrostatic paint sprayer and the panels are maintained at a negative DC potential with respect to ground.

It is still a further object of the present invention to provide a new and improved method of electrostatically spray painting objects in which the electrostatic paint sprayer is charged to a potential of 60,000 to 135,000 volts DC negative with respect to ground and the panels forming at least some of the internal surfaces of the spray booth are charged to a potential of 30,000 volts DC negative with respect to ground.

It is yet another object of the present invention to provide new and improved panels for use in spray booths for electrostatically spray painting objects, which panels include a conductive sheet completely enclosed in a dielectric material, such as plastic.

In accordance with these and many other objects of the present invention, a spray booth embodying the present invention includes encapsulated electrically charged panels which are adapted to repel electrically charged dry or wet coating particles that are produced by an electrostatic spray painting system for electrostatically painting objects. Such booths include an electrostatic paint sprayer which may be charged to a potential of 60,000 to 135,000 volts DC negative with respect to ground. The sprayer produces a spray of dry or wet paint particles which is negatively charged. An object or article to be painted is disposed in the booth and is maintained at ground potential. The encapsulated, electrically charged panels or walls of the booth are charged to a potential between the negative DC potential with respect to ground to which the spray gun is charged and the ground potential of the target to be painted. For example, the panels may be charged to a potential of 30,000 volts DC negative with respect to ground by a power supply provided a with current limiter. The resulting electrostatic field emanating from these panels repels paint particles that do not adhere to the target and thereby reduce the amount of paint that would otherwise accumulate on surfaces of the spray booth near the target.

By reducing the accumulation of overspray paint on surfaces near the target, the present invention reduces the frequency with which dripping or flaking paint falls onto a target during the painting process and thereby reduces the number of objects that are rejected. In addition, paint repelled by the charged panels is redirected back towards the target and may be attracted to the object. In this way, the present invention increases the efficiency of the use of paint by reducing the amount of paint wasted on surfaces other than the target and reduces the number of rejected objects. Moreover, the painting booth may be more efficiently used because the amount of time that the booth is out of service for cleaning is reduced.

In one embodiment of the present invention, each electrically charged panel includes a conductive sheet completely enclosed in a dielectric material such as plastic. For example, the panel may include an electrically conductive sheet of aluminum laminated in plastic. An electrical power source capable of placing an electric potential on the surface of the encapsulated electrically conductive sheet is used such that a repelling field is produced of an electric potential of the same sign as and of sufficient strength to repel the electrically charged paint particles. Even though the conductive sheet is embedded in plastic, the electrical field created by the charged conductive sheet is not impeded by the insulation of the plastic. When such panels are used to line the internal surfaces of an electrostatic spray painting booth and charged to a voltage of the same sign as the electrically charged paint, overspray paint is repelled as described above and consequently painting can take place closer to a conveyor protector or the ceiling of the booth. In addition, shorter article hangers can be used and longer or larger articles can be painted in a smaller booth.

The use of such panels also reduces the capital expenditure required to build a new painting booth and other process equipment by decreasing the size of the booth necessary for painting targets of a particular maximum size. The fact that the panels have a plastic surface also makes it easier to clean paint from the panels than from a surface other than plastic. Being easier to clean than other surfaces, the panels of the present invention decrease the amount of labor necessary to clean accumulated overspray from the surfaces of a painting booth. This reduction of labor increases the efficiency of the painting booth by decreasing the amount of time when it is out of service for cleaning.

BRIEF DESCRIPTION OF THE DRAWINGS

Many other objects and advantages of the present invention will become apparent from considering the following detailed description in conjunction with the drawings in which.

DETAILED DESCRIPTION OF THE PREFERRED EMBODIMENT

Figure 1:
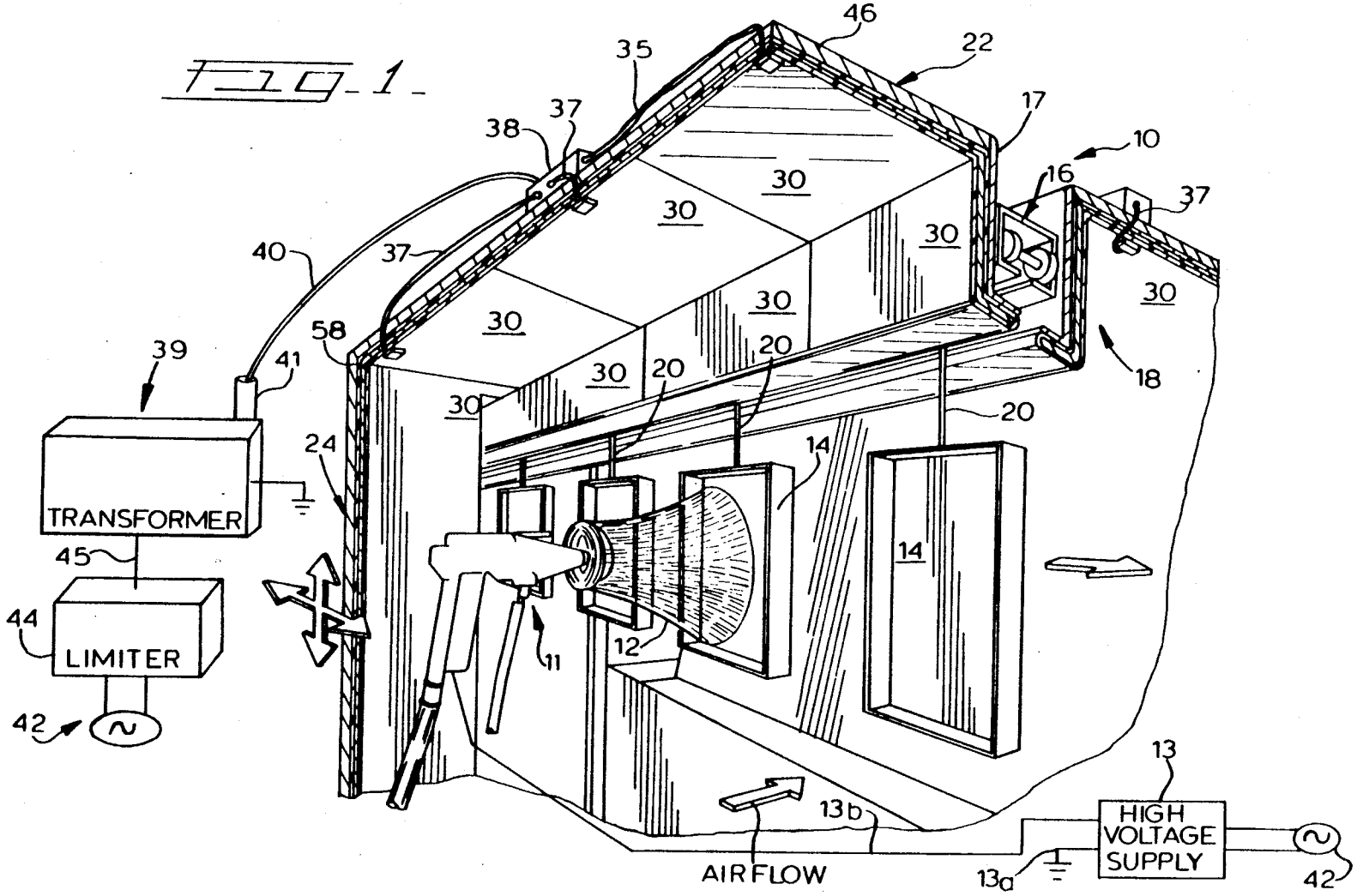
FIG. 1 is a diagrammatic view of an electrostatic spray painting booth embodying the present invention.

Referring now more specifically to the drawings and in particular to FIG. 1, therein is shown a spray booth embodying the present invention and generally designated by the reference numeral 10. The spray booth 10 includes an electrostatic paint applying or spray gun apparatus 11 that is capable of generating a paint spray 12 having a plurality of paint particles or paint droplets. The electrostatic paint applying apparatus 11 may be charged to a high negative DC voltage, such as a negative 60,000 to 135,000 volts DC, by a high voltage power supply 13 having a grounded lead **13*a* and a power lead 13*b* coupled to the electrostatic paint applying apparatus 11. The paint spray 12 produced by the spray gun apparatus 11 is electrostatically attracted to an object, article or target 14 that is to be painted because the object 14 is maintained at ground potential. As shown in FIG. 1, the object 14 is conveyed through the booth 10 by an overhead conveyor mechanism 16. As disclosed in U.S. Pat. Nos. 3,749,229 and 4,207,833, the conveyor mechanism 16 may be enclosed by a conveyor protection housing 18 in which pressurized air is circulated. The objects 14 to be spray painted are suspended from the conveyor mechanism 16 by electrically conductive hangers 20**.

In prior art spray paint booths, the objects to be spray painted and walls of the spray booth both were maintained grounded. As a result, an electrostatic field was established by the potential difference between the electrostatic paint applying apparatus on the one hand and the target and other grounded members of the spray booth on the other hand. In electrostatically painting the target, some of the paint particles did not impinge on the target. Instead, these overspray particles were electrostatically attracted to the grounded walls of the spray booth. When such paint adhered to the walls of the spray booth and did not dry, the paint tended to drip from overhead wall structures. Even when the paint adhered to the walls of the spray booth and did dry, the paint would tend to flake or chip off. The loose flakes could fall and adhere to the freshly painted surface on the target resulting in defective painted parts. Moreover, the paint that collected on the booth surfaces rather than on the object to be painted was wasted and the paint accumulated on the booth surfaces had to be removed. This resulted in costly maintenance problems and the spray booth could not be used during the time the maintenance was being performed. Consequently, the production efficiency of the booths adversely was affected.

In accordance with the present invention, the amount of electrostatic paint spray particles 12 that are attracted to and collect on the conveyor protection housing 18 and ceiling 22 or other walls 24 in the spray booth 10 is substantially reduced. As a result, a higher percentage of the paint spray particles 12 generated by the paint spray apparatus 11 actually is deposited on the articles 14 to be painted. This is achieved by providing a plurality of panels or walls 30 positioned at areas which typically become coated with overspray paint in the booth 10. Typically such panels 30 may be used as the panels for the ceilings 22 above the articles 14, on the exposed sides of the conveyor housing 18 and on the side walls 24 of the spray booth 10.

Each panel 30 has a large encapsulated conductive sheet or surface 32 which, for example, may be an aluminum sheet or foil, and which is electrically charged to create a repelling field of the same polarity to that of the charged paint particles 12. The metal sheets 32 need not necessarily be solid panels of metal but instead may be made of a metal mesh. Alternatively, a good electrical conductive material other than metal could be used in place of the metal sheets 32. For example, the metal sheets 32 could be formed with a conductive coating or salts. However, it is preferred that the conductive material, whether it is a conductive sheet, a mesh, salts or conductive coating, be encased in dielectric laminates.

The laminated panels 30 are charged to a DC potential that is between ground potential and the potential at which the paint spray apparatus 11 is maintained. In the preferred embodiment of the present invention, the laminated panels 30 are charged to a negative 30,000 DC volts with respect to ground. When the panels 30 are so charged, a large repelling field of the same polarity as the paint particles 12 is produced. Advantageously, the amount of downtime required for cleaning the booth 10 is reduced substantially. In addition, less paint is applied to the booth ceiling 22 and the conveyor protection housing 18 so that it becomes less likely that accumulated overspray will drip or flake off onto an article 14 being painted and cause a defect in the coating being applied to the article 14.

Depending on the particular spray booth 10 and the objects 14 to be painted, the panels 30 may be shaped to be flat, curved, bent at an angle or some combination thereof that is best suited to repel the electrically charged paint particles 12. The panels 30 that are used as the walls 24 and the ceiling 22 of the spray booth 10 may be relatively large (for example, the panels 30 may be four feet by eight feet or three feet by six feet).

In the case of the panel 30 shown in FIGS. 1–4, the electrically conductive sheet 32 in each of the panels 30 are protected or covered by a dielectric material in the form of outer plastic layers 33–34 that prevent any exposure of the charged conductive sheet 32 to the atmosphere or physical contact. The plastic layer material 33 or 34 may be a polypropylene material which can be easily cleaned of paint. Alternatively, the outer dielectric layers 33–34 may be made of glass or porcelain.

At edges 33*a* and 34*a* of the sheets 32, a weld 35 of polypropylene (FIG. 4) provides a thick bead to encase the edges 32*a* of the metal sheet 32. As a result, the metal sheet 32 is surrounded on all sides and edges by the plastic material. If desired, the welds 35 can be eliminated if the metal sheet 32 is molded in plastic so as to completely embed the sheet 32 in the plastic material. Alternatively, the edges of the plastic panels 33 and 34 may be extended to double the arcing distance of the negative 30,000 volts DC which also will effectively isolate the metal conductor from ground potential.

Figure 2:
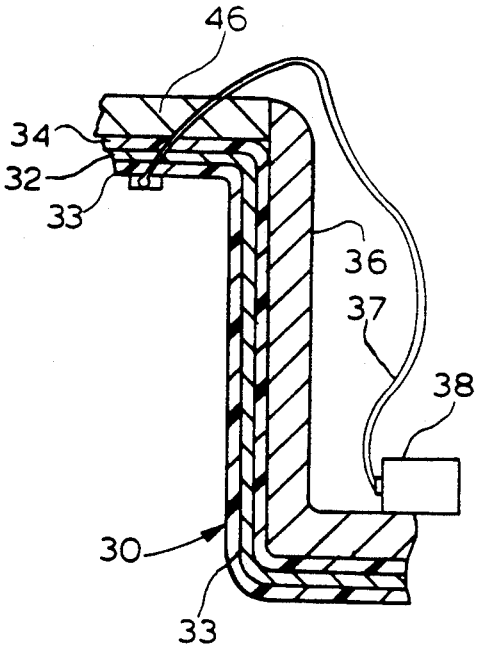
FIG. 2 is a sectional, fragmentary view illustrating a paint repelling panel that may be used in the spray painting booth illustrated in FIG. 1.
Figure 4:
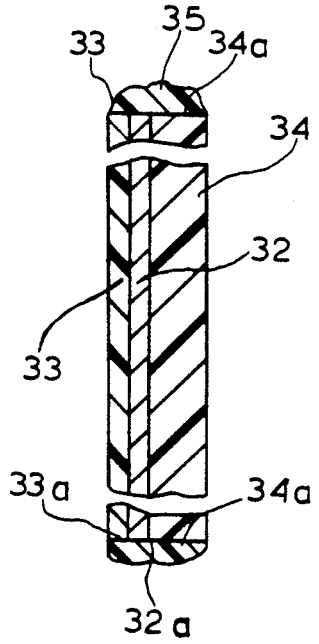
FIG. 4 is an enlarged cross-sectional view of a portion of the paint repelling panel shown in FIG. 3.

As seen in FIG. 2, the polypropylene surface of the panel 30 forms an inner wall of the spray painting booth 10 whereas the opposite polypropylene surface 34 of the panel 30 is mounted on a wall 36 of the spray booth 10. In one embodiment of the present invention, the plastic layer 33 facing inwardly into the 10 spray booth 10 may be made about 1/16" thick whereas the plastic layer 34 positioned against the outer housing wall 36 of the spray booth 10 may be made about ¼" in thickness. If a booth 10 is constructed with such panels 30, the booth 10 may be made smaller in size than corresponding spray paint booths that previously were used thereby reducing substantially the cost of the booth 10.

Referring again to FIG. 1, the booth 10 is provided with the paint repelling panels 30 at the locations where the paint particles 12 are most likely to accumulate on the booth walls 24, the booth ceiling 22 and/or on the overhead conveyor protection housing 18 which is disposed immediately above the articles 14 being painted. Typically, the spray gun apparatus 11 is moved vertically or horizontally by automatic equipment (not shown). As a result, the spray gun 11 may be positioned close to the conveyor protection housing 18. An excess of 250 tests have been run using charged wires or charged panels exposed to the atmosphere and charged panels, such as the panels 30, encapsulated in plastic. The charged panels 30 encapsulated in plastic provided the most effective result with virtually no hazard factor. When the encapsulated panel was charged to a negative 30,000 volts DC, the optimum repelling effect was obtained. When higher negative voltages were used (for example approximately 100,000 volts DC negative), the resulting electric field emanating from the panels 30 actually attracted the paint particles 12 instead of repelling those particles 12.

Figure 5:
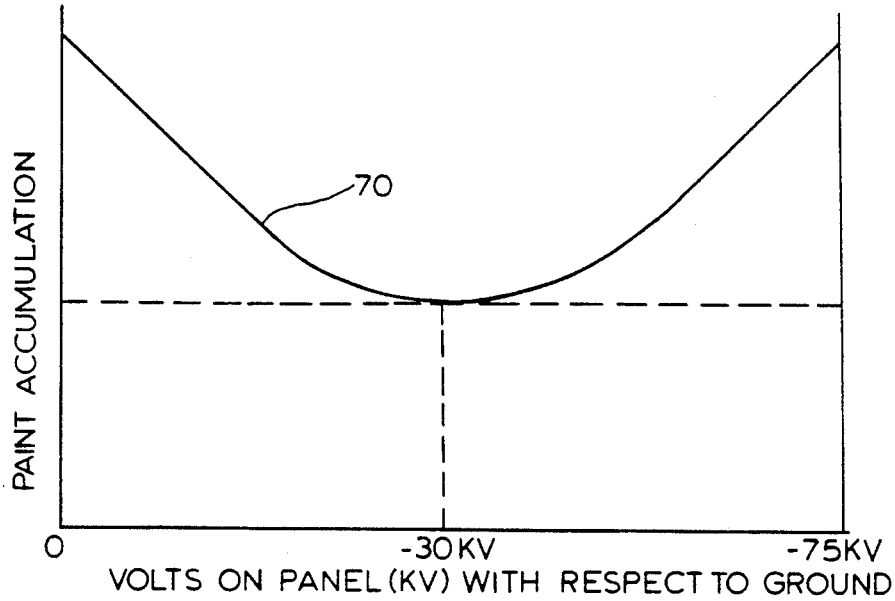
FIG. 5 is a graph showing the amount of overspray paint that accumulates on a paint repelling panel as a function of the voltage on the panel with respect to ground.

In this regard, reference can be made to FIG. 5 of the drawings. That figure graphically shows a curve 70 which represents the accumulation of spray paint on the panels 30 as the voltage on the panel is varied with respect to ground potential. As shown therein, the panels 30 tend to repel the most paint and minimize the accumulation of charged paint particles 12 on the panel 30 when the panels 30 are charged to a negative 30,000 volts DC.

In the tests that were conducted, a variety of electrostatic atomizing devices including 60,000 to 135,000 volt air spray guns and rotary atomizer (bells) were used. The paint repelling ability of the panels 30 was not affected by the type of atomizing device or the voltage level applied to the atomizer. Regardless of the type of atomizing device, over 95% of the charged painted particles 12 that would normally collect on grounded surfaces were repelled when the atomizing device was positioned about 12 inches from the repelling panels.

As best seen in FIG. 1, the conductive sheets 32 in the panels 30 are electrically connected by means of a plurality of electric leads 37 (shown schematically), each of which leads 37 extends from a panel 30 to a common splitter box 38. The common splitter box 38 is coupled to a transformer 39 by a cable 40 that extends in a protective duct 41 (shown partially broken away). The electrical transformer 39 has a rectifier so that a direct current output can be produced when the transformer 39 is connected to an AC power source 42. While the transformer 39 is capable of generating the desired voltage (for example, a negative 30,000 volts DC), the voltage may be varied to suit the individual needs of the spray booth 10. However, the current generated by the transformer 39 is maintained low, for example, in a range of 10 to 50 microamps. It is preferred to utilize a limiter 44 with the transformer 39. The limiter 44 is coupled by a cable 45 and detects a current rise so as to shut off the transformer 39 before arcing can occur in the event an insulation fault occurs in one of the panels 30. The limiter 44 may be set at 10 microamps above the normal operating current being drawn from the transformer 39 so that when the current begins to rise to signify incipient arcing, the transformer 39 is shut off and the voltage is no longer applied to the conductive sheets 32 in the panels 30. In view of the fact that the transformer 39 may be of the type that is capable of producing a significant amount of power, the transformer 39 may be coupled to a plurality of adjacent booths, like the booth 10.

Figure 3:
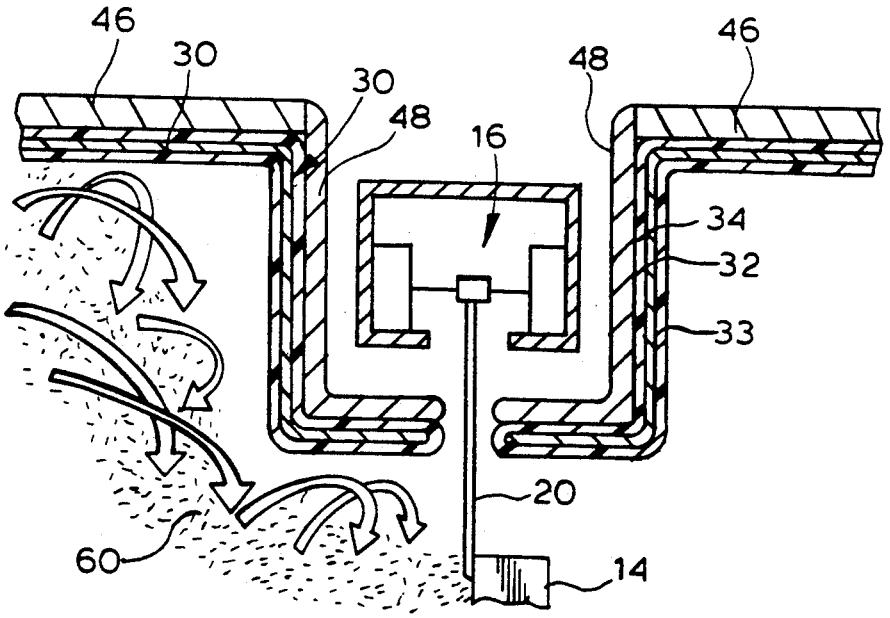
FIG. 3 is a sectional, fragmentary view showing other paint repelling panels that may be used in the spray painting booth illustrated in FIG. 1.

As previously indicated, the spray gun apparatus 11 sprays negatively charged paint droplets or particles 12 at the target 14. If the spray gun apparatus 11 is charged to a potential of a negative 100,000 volts DC with respect to ground at its nozzle 11*a* and if the transformer 39 charges the aluminum sheets 32 of the panels 30 to a negative 30,000 volts DC with respect to ground, the spray gun 11 can be operated as close as one foot from any of the grounded surfaces, such as the articles 14, when the hanger 20 of the overhead conveyor mechanism 16 is approximately one foot in length. Nevertheless, some negatively charged paint droplets 12 will miss the target 14 and approach the panels 30. In this regard, FIG. 3 generally depicts a cross-sectional view of the panels 30 that are mounted against a ceiling 46 of the spray booth 10 and against a wall 48 of the conveyor housing 18. In FIG. 3, the arrows 60 illustrates how the charged paint particles 12 are repelled from the panels 30 when the aluminum sheets 32 of the panels 30 are charged to a negative 30,000 volts DC due to the electric field that is produced which repels the negatively charged particles 12. As the paint particles 12 are repelled and redirected toward the article 14, some of the repelled paint particles 12 adhere to the article 14 and other of the particles 12 are carried off to air filters (not shown).

Figure 6:
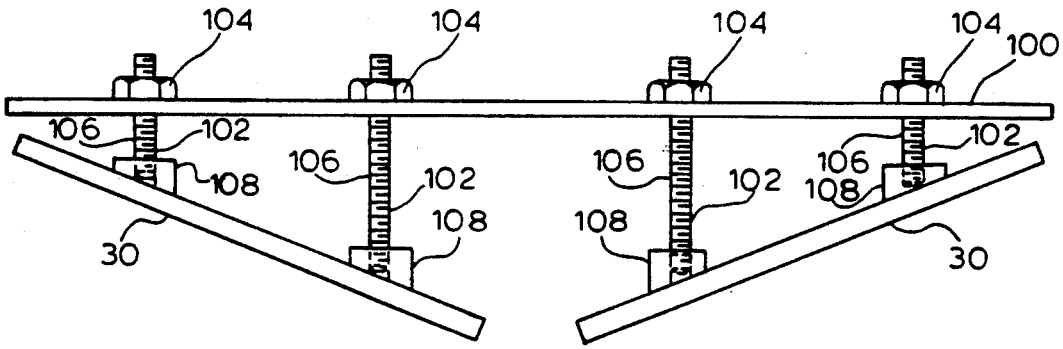
FIG. 6 is a side elevation view of a pair of panels embodying the present invention, the panels being suspended from a plurality of insulating stringers.

As may be seen in FIG. 6 of the drawings, the panels 30 may be suspended from a structure 100 forming a portion of the spray booth 10 or an adjacent booth like the spray booth 10 by a plurality of threaded metal rod type stringers 102. Each of the stringers 102 is held to the structure 100 by a nut or threaded block 104 that is threadedly engaged by a threaded metal rod 106. The elongated rod 106 extends to the panels 30 from the structure 100 and are threadedly connected to polypropylene blocks 108 which are welded to the panels 30. The stringers 102 permit the panels 30 to be positioned at a variety of distances from the structure 100 and in a variety of orientations with respect to the structure 100 so that the booth 10 may be specifically designed for the type of products being coated.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A coating booth having an electrostatic coating device for producing coating particles electrically charged with a first negative DC potential in order to coat articles with said coating particles, said coating booth comprising:

a plurality of panel means forming at least some of internal surfaces within said coating booth, at least some of said panel means having a conductive means covered by a dielectric material;

grounding means for supporting and grounding said articles to be coated such that said coating particles are attracted to said articles; and electrical means coupled to said conductive means of said panel means to apply a panel potential to said panel means, said panel potential being between said ground potential and said first negative DC potential such that said coating particles tend to be repelled from said panel means.

2. A coating booth as set forth in claim 1 wherein said conductive means is a sheet of aluminum having a large surface area.

3. A coating booth as set forth in claim 1 wherein said dielectric material is a layer of polypropylene.

4. A coating booth as set forth in claim 1 wherein said dielectric material is a layer of plastic.

5. A coating booth as set forth in claim 1 wherein said dielectric material is a layer of glass.

6. A coating booth as set forth in claim 1 wherein said conductive means is a sheet of metal.

7. A coating booth as set forth in claim 1 wherein said conductive means is metal mesh.

8. A coating booth as set forth in claim 1 wherein said dielectric material encapsulates said conductive means.

9. A coating booth as set forth in claim 1 wherein said dielectric material extends beyond the edges of said conductive means.

10. A coating booth as set forth in claim 1 wherein each of said panel means is at least one foot by one foot.

11. A coating booth as set forth in claim 5 including conveyor means for conveying said articles within said coating booth, at least some said plurality of said panel means forming a conveyor protective housing for said conveyor means.

12. A spray paint booth apparatus for electrostatically painting a target with paint particles emitted from a paint spraying means, said spray paint booth apparatus comprising:

paint spray charging means for charging said paint spraying means to a first direct current potential that is negative with respect to ground potential such that said paint particles emitted from said paint spraying means have a first negative DC potential with respect to ground;

target conveying means for conveying said target in said spray paint booth apparatus and coupling said target to ground potential so that the electrically charged paint particles emitted by said paint spraying means are attracted toward said target;

a plurality of wall means at least partially forming internal surfaces within said spray paint booth apparatus, said wall means being disposed in spatial relationship with respect to said target, at least some of said wall means including conductive means covered by a dielectric shield; and wall charging means for charging said at least some of said wall means to a second negative DC potential of approximately 30,000 volts DC negative with respect to ground, said second negative DC potential being intermediate said first negative DC potential and said ground potential such that said paint particles tend to be repelled from said at least some of said wall means charged to said second negative DC potential.

13. A method of electrostatically paint spraying articles in an enclosure having walls, at least some of said walls of said enclosure include a conductive means covered by a dielectric shield, said method comprising the steps of:

conveying at least one article to be painted into said enclosure;

electrically charging a paint applicator device to a first higher negative potential than a negative 30,000 volts DC so as to produce electrically charged paint particles that are directed toward said article, said charged paint particles being charged to said first potential;

electrically grounding said article to be painted, the potential difference between said first potential on said charged paint particles and said grounded article creating an electric field so that said paint particles are attracted to said article being conveyed through said enclosure; and electrically charging said at least some of said walls in the enclosure to a potential of approximately negative 30,000 volts DC with respect to ground so that the resulting electric field created by said wall deflects paint particles from said wall.

* * * * *